United States Patent [19]

Nishio et al.

[11] 4,400,643

[45] Aug. 23, 1983

[54] WIDE THERMAL RANGE SPARK PLUG

[75] Inventors: Kanemitsu Nishio, Komaki; Shunichi Takagi, Tajimi; Yasuhiko Suzuki, Nagoya, all of Japan

[73] Assignee: NGK Spark Plug Co., Ltd., Nagoya, Japan

[21] Appl. No.: 205,912

[22] Filed: Nov. 12, 1980

[30] Foreign Application Priority Data

| | | | |
|---|---|---|---|
| Nov. 20, 1979 | [JP] | Japan | 54-150259 |
| Dec. 18, 1979 | [JP] | Japan | 54-164352 |
| Dec. 21, 1979 | [JP] | Japan | 54-165701 |

[51] Int. Cl.[3] ..... H01T 13/16; H01T 13/20

[52] U.S. Cl. ..... 313/11.5; 313/141

[58] Field of Search ..... 313/11.5, 141, 142

[56] References Cited

U.S. PATENT DOCUMENTS

| | | | |
|---|---|---|---|
| 2,296,045 | 9/1942 | McDougal et al. | 313/142 X |
| 2,487,531 | 11/1949 | Dutterer | 313/11.5 X |

*Primary Examiner*—Palmer C. Demeo

*Attorney, Agent, or Firm*—Wegner & Bretschneider

[57] ABSTRACT

A spark plug including an insulator body provided with a center bore and a bottom end defining a discharge end of the insulator body and a discharge center electrode formed in a region of the discharge end of the insulator body; a spark plug including thermal conductivity-controling material comprising spherical metal powder as an essential element thereof in the center bore providing function to control thermal conductivity of the spark plug. The conductivity controling material further comprises refractory powder and glass powder. The controling material is also composed of spherical metal powder coated with a ceramic layer of a mixture thereof with the spherical metal powder. The spark plug with the controling material permits an increasing conductance according to temperature rise to provide a thermally wide-ranged spark plug.

31 Claims, 14 Drawing Figures

PRIOR ART

WIDE THERMAL RANGE SPARK PLUG

FIELD OF THE INVENTION

The present invention relates to a spark plug which has an extended heat range and good durability in use.

BACKGROUND

Generally, extension of the heat range (thermally wide-ranging) and durability of a center discharge electrode are essentially required as characteristics for the spark plug. Since the spark plug is exposed to combustion or explosion gas having a temperature of up to 2,000 degrees centigrade in high speed running of an engine, it is essential to release or disperse the heat from the spark plug, particularly from the discharge end thereof. On the other hand, carbon or composite mass deposit and accumulate on the spark plug at the periphery of the discharge electrode during idling or low speed running, which must be burned out to keep the spark plug clean. It has been acknowledged in the prior art that it is necessary to maintain the discharge end of the insulator body in the spark plug approximately within a thermal range of 450°–900° C. to avoid overheating and deposition of carbon or sooting. However, the temperature of the discharge end widely varies depending upon the kind of engine, running condition, fuel used, change of seasons, i.e., hot or cold surroundings and the like.

Therefore, it is essential to effectively release the heat of the spark plug discharge end transmitted from the engine for avoiding overheating or for avoiding the soot deposition in order to maintain good spark plug function under these different conditions. That is, it is necessary to maintain the discharge end within the prescribed temperature range. The discharge end temperature should not exceed the maximum allowable limit, which consequently requires the discharge end to function to eliminate overheating so that pre-ignition may be restrained in high speed running, as well as the center discharge electrode heat properties.

However, there is much to be desired in the prior art as these two different properties cannot realized in a spark plug of the prior art, i.e., it has been difficult for a spark plug provided with an appropriate temperature range (heat value) under a specific running condition simultaneously to have such properties as non-soot-deposition (selfcleaning ability), eliminating overheating and heat-resistance.

Generally in a conventional spark plug, a center electrode rod (center rod) plays a dominant role in releasing the heat of the discharge end. Thus the conventional center rod composed of a single rod of nickel alloy has come to be replaced with a copper-cored nickel alloy rod which has a copper core rod axially extending throughout the nickel rod. Those nickel alloy center rods show either an almost constant, even thermal conductance or a descending conductance despite rising temperature. Similarly, in the case of copper-cored nickel alloy center rods, no increase in thermal conductance is observed as the temperature rises. Accordingly, such conventional spark plug structures of the prior art are almost incapable of changing thermal conductivity, i.e., thermal conductance corresponding to temperature or heat conditions of the discharge end.

It is much desired by spark plug users to improve the adaptability of spark plugs to temperature changes at their discharge ends, i.e., to provide a wide thermal range.

As shown in FIG. 11, a conventional spark plug comprises a rod-like metal center electrode 29 made of a copper-cored nickel alloy rod running through the axial center bore of an insulator body at the discharge end, the stepped shoulder formed on an inner wall of the center bore receiving a flange-portion with an enlarged diameter of the center electrode, whereupon a conductive sealing glass composition 27*a* is applied. In such a structure, the center electrode rod 29 must be in tight contact with the insulator body 21 at high temperatures for enabling heat release from the discharge end. This requires an even, constant clearance t between the center electrode rod 29 and the insulator body 21 during manufacture (at a low temperature). With a too broad clearance t the heat will accumulate at the discharge end resulting in overheat whereas a too small clearance t will cause the insulator to break due to thermal expansion of the electrode rod 29.

Thus precise and complicated process control to maintain a prescribed clearance t is necessary for manufacturing the conventional type of spark plug provided with a rod-like center electrode, i.e., controlling center bore diameter of the insulator body, inserting and setting of the center electrode rod with an even clearance in the center bore or the like, which also hinders product cost reduction.

Now with respect to durability, the discharge center electrode sustains wear due to oxidation, lead attack through spark discharges which cannot be avoided without replacing the electrode with, e.g., a noble metal electrode. Employment of such a noble metal is, however, disadvantageous due to its high cost. The electrode sustains wear also through direct exposure to exploding gas at a high temperature and high speed.

Accordingly it is an object of the present invention to provide a novel spark plug eliminating drawbacks of the prior art as aforementioned.

Another object of the present invention is to provide a spark plug of an essentially novel structure.

A further object of the present invention is to provide a spark plug with an extended heat range.

A fourth object of the present invention is to provide a spark plug having a self-cleaning discharge end.

A fifth object of the present invention is to provide a spark plug using heat conductivity-controling material which shows higher thermal conductivity with rising temperature.

A sixth object of the present invention is to provide a spark plug provided with a resistor incorporated therein and better heat releasability from the discharge end toward a terminal rod.

A still further object of the present invention is to provide a spark plug which can be manufactured at low cost.

BRIEF DESCRIPTION OF DRAWINGS

Other objects of the present invention will become apparent from disclosure hereinbelow in the specification and drawings, in which each Figure shows as follows.

SUMMARY

Figure 1:
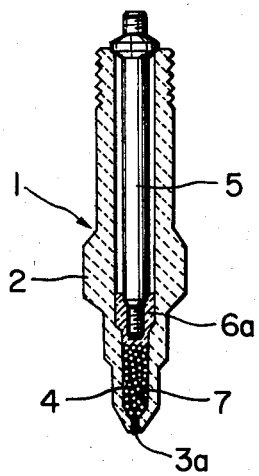
FIG. 1 shows an embodiment of the present invention in its cross-sectional view of an insulator body assembly.
Figure 2:
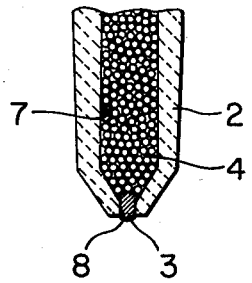
FIG. 2 shows an enlarged portion of FIG. 1.

In light of foregoing observations on the prior art and according to the applicant's investigations, the applicant holds that following requirements must be complied with for accomplishing a wide thermal range spark plug: the thermal conductivity of the center electrode rod portion (alternatively an internal portion of the center bore) must be capable of effectively being changed in correspondence with temperature of the spark plug discharge end portion or a neighbouring portion therewith. More particularly, the conductivity of the center electrode rod portion (or center discharge end portion) at low temperature must be depressed to allow the heat to accumulate at the discharge end portion and to make and maintain its temperature as high as possible so that the carbon deposit may be burnt out to aid self-cleaning, while the conductivity at a high temperature must be enhanced to release the heat and to avoid overheating of the discharge end portion so that preignition may be avoided.

In the present invention, these requirements can be satisfied by sealing a thermal conductivity-controlling material having an appropriate particle size and comprising spherical metal powder as an essential element thereof, which controls the thermal conductivity of the spark plug, at the portion occupied by the conventional center electrode rod (center electrode rod portion) in the discharge end region of the center bore.

In the present invention, optional incorporation of refractory powder (second embodiment) or further additional incorporation of glass powder (third embodiment), similarly being sealed, can aid in accomplishment of the above requirements. The glass powder may also be employed in the fourth embodiment but is not necessary.

As a fourth embodiment of the invention, said requirements are further accomplished by sealing a thermal conductivity-controlling material which comprises spherical metal powder coated with a ceramic coating layer in the same portion; and also by sealing thermal conductivity-controlling material which comprises the spherical metal powder and the ceramic-coated spherical metal powder (a fifth embodiment).

A sixth embodiment of the invention provides a spark plug which comprises the thermal conductivity controlling material in the center bore from its discharge end bottom approximately up to the level of a stepped shoulder on the insulator body which is the first one from the discharge end and is adapted to receive a metal shell to be mounted on the insulator body.

A seventh embodiment of the invention provides a spark plug which comprises a mixture powder of the spherical metal powder and the refractory powder, the mixture powder including a higher amount of the spherical metal powder provided with the higher thermal conductivity, the nearer to the center discharge electrode end being a pertinent portion in the center bore.

An eighth embodiment of the invention provides a spark plug comprising a ceramic center discharge electrode which is simultaneously sintered with the insulator body and composed of a complex electrode material of a platinum group metal and a ceramic material. This embodiment further comprises electrical resistor material for noise elimination sealed in the center bore in order of the thermal conductivity-controling material and the resistor material beginning from the discharge end.

DETAILED DESCRIPTION OF THE INVENTION

In the following each embodiment is further disclosed in detail.

The First Embodiment

The spherical metal powder in the invention is that having an approximately spherical form, a completely spherical one being preferred but not necessary, i.e., it permits modification of the form defined through a manufacturing process or admixture of such modified forms.

The term "thermal conductivity-controling material" ("controling material" hereinafter) denotes specific functional material developing such function that yields a low thermal conductance at a low temperature and gradually enhances the conductance according to temperature rise, which material consists of single element or complex elements or material.

Figure 3A:
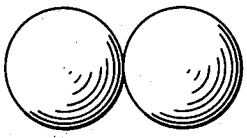
FIG. 3*a* and 3*b* schematically show the state of the spherical metal powder at a low and high temperature, respectively.
Figure 3B:
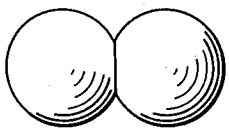
Figure 4:
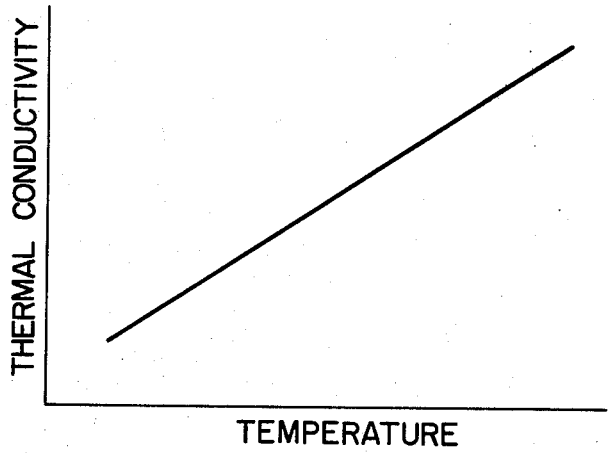
FIG. 4 shows the relation between thermal conductivity and temperature in a thermal conductivity controlling material.

The spherical metal powder ("metal powder" hereinafter) sealed in the center bore is one embodiment of such controling material, which develops the following function: The metal powder properly sealed in the center bore is in a densely packed normal condition (FIG. 3*a*) at a low temperature, under which condition the metal powder is subjected to thermal expansion if the temperature rises. The amount of the metal powder expansion is sufficiently larger than that of the ceramic insulator body to cause the metal powder to deform as shown in FIG. 3*b* within an elastic deformation range up to some predetermined limit resulting in enhanced contact area between two neighbouring spherical metal powder particles accompanied by an enlarged thermal conductance. This relation is graphically illustrated in FIG. 4 (qualitatively represented).

The metal powder employed in the invention is one that has a high thermal conductance and an appropriate expansion coefficient within a prescribed temperature range, and remains within the elastic deformation zone, i.e., has restorability as well as good reproducibility on repetition.

The controling material complying with such requirements encompasses metal powders of copper, iron, nickel, chromium, alloys thereof, or copper alloys with Sn, Zn, Al and/or Pb. A mixture of those metal powders is also employed. The term "iron" hereinabove represents not necessarily pure iron but normally steel, preferably mild steel, with low carbon content and other known minor ingredients.

The alloys encompass ferro-alloys or nickel-alloys of Fe-Ni, Fe-Cr, Fe-Ni-Cr and Ni-Cr; copper alloys or Cu-Ni and Cu-Cr; and copper alloys of Cu-Zn, Cu-Zn-Pb, Cu-Sn-P, Cu-Sn-Zn, Cu-Al, Cu-Al-Ni-Fe and Cu-Zn-Al, i.e., copper alloys with metals having a substantially lower melting point. These metal powders can repeat expansion and contraction (restoration to the original state) according to the rise or descent of the temperature within a temperature range of approximately from 400° to 900° C. wherein the metal powders remain in the elastic zone. The thermal conductivity varies in approximate proportion to the change of the contact area, i.e., the conducting area between the spherical powder particles, which enables control of the thermal conductivity according to the temperature. Among the metal powders listed above, copper, copper alloys and Fe-Ni-Cr (8% Ni, 18% Cr stainless steel) are preferred.

Such metal powders have a mean particle size of approximately from 100 to 1,000 μm, preferably from 200–800 μm. For example, the Cu-Ni alloy comprising 70–95% Cu and the balance of Ni (cupro-nickels), the Cu-Cr alloys comprising 97–99.5% Cu and the balance of Cr (chromium copper), brass comprising 5–40% Zn and the balance of Cu, an alloy comprising 5–40% Zn, 2–3% Pb and the balance of Cu, phosphor copper comprising 4–8% Sn, 0.1% P and the balance of Cu, aluminium bronze comprising 5–10% Al and the balance of Cu or 8–10% Al, 1–5% Ni, 2.5–3.0% Fe and the balance of Cu, and aluminum brass comprising 22% Zn, 2% Al and the balance of Cu, each % by weight ratio, are employed to advantange. Generally, the metal powder should be of high thermal conductance, particularly at over 700° C. and have heat-resistance and a large expansion coefficient. The content of Zn in the copper alloy is limited to a maximum 40% by weight as a higher content of Zn renders too low a melting point.

The metal powder is included in the controlling material as an essential element thereof, i.e., at least 60% by volume (theoretical ratio, same as hereinafter) of such metal powder is included in the controlling material composition for good conductivity.

The Second Embodiment

According to the second embodiment of the invention, the control material comprises the metal powder aforementioned and from 10 to 40% by volume of a refractory powder, preferably of from 10 to 30% by volume. This refractory powder which has good thermal conductivity and is exemplified as follows: metal oxide (alumina), nitride of aluminium or titanium, carbide of silicon, titanium, zirconium or boron, silicide of molybdenum or titanium, or mixtures thereof. The refractory powder particles have a mean particle size of approximately 10–500 μm, preferably not exceeding 200 μm, so that the refractory powder fills the surrounding space of the metal powder and covers the surface thereof. The incorporation of the refractory powder of the specified particle size prevents the metal powder from sintering with each other as well as adjusts the thermal expansion coefficient of the control material to a desired value. The metal powder should be included not less than 60% by volume in the controlling material in order to secure the controlling function. Incorporation of less than 10% by volume of the refractory powder barely develops the desired effect, whereas incorporation thereof of more than 40% by volume decreases the electrical conductivity of the controlling material. Among the aforementioned refractory powders carbides having good electrical conductance such as TiC, SiC. Mo2C and B4C which have also high thermal conductances are preferred.

The Third Embodiment

The present invention further provides a spark plug which incorporates additionally 0–20%, preferably 5–10%, by volume of glass powder in the controlling material comprising the metal powder and the refractory powder. The glass powder incorporation enables the control material to be maintained free from crack formation. This glass powder is a borosilicate glass having a softening point of approximately 600°–900° C. A more preferred borosilicate glass used in the Examples has a composition of 30% $B_2O_3$, 65% $SiO_2$ and 5% $Al_2O_3$ by weight ratio.

In this case, the metal powder should be included at not less than 60% by volume in the controlling material. An exemplified composition of this embodiment is that comprising 60–90% spherical copper powder and the balance (preferably 10–20%) of powder consisting of alumina and/or silica and 0–20% (preferably 5–10%) of the borosilicate glass powder each by volume percent.

The Fourth Embodiment

The controlling material of the invention further comprises the metal powder coated with a ceramic coating layer as the essential element thereof, which coated metal powder enables controlling in a different thermal range from the case applying the single metal powder (first embodiment) as well as securing durability of the control function for a long period. The ceramic coating layer acts to separate metal powder particles from each other.

The ceramic coating layer is an oxidized layer of the metal powder or a thin coating layer substantially formed with fine ceramic powder selected from the group consisting of oxide (alumina, titania, zirconia, silica and the like), carbide (of Ti, Si, Mo, B and the like), nitride (of Al, B, Ti, Zr and the like) and silicide (of Mo, Ti and the like). A complex layer of the foregoing powders is also employed. The ceramic coating layer has thickness of approximately 5–30 μm for achieving the desired controlling function. Among the ceramic powders, those having a good electrical conductance such as $TiO_2$, carbides as above mentioned or $MoSi_2$ are preferred.

The oxidized layer on the metal powder can be formed with ease by way of a heat treatment, e.g., of copper powder having a mean particle size of 500 μm at 500° C. for one hour in the atmosphere. Such oxidized layer on the other metal powders of iron, nickel and chromium can similarly be formed through heating them at a temperature of 500°–800° C. The alloy powders of those metals aforementioned are also heat-treated at an appropriate temperature (usually around 700° C.). The oxidized layer is approximately 5–15 μm thick.

Other ceramic coating layers with the ceramic powder can be formed, e.g., through drying the metal powder after dipping it in a slurry of ceramic powdery material.

The Fifth Embodiment

The fifth embodiment of the invention provides a spark plug employing a controlling material comprising 10–90% by volume of the spherical metal powder with the ceramic coating layer and the balance of the spherical metal powder as the essential element for the controlling material. Outside of the above mixing ratio, the effect of mixing two kinds of spherical metal powders is hardly observed.

The Sixth Embodiment

The sixth embodiment of the invention relates to a structural configuration of the spark plug employing the control material.

Spark plugs provided with ceramic center discharge electrodes or tip-like metal center discharge electrodes may be employed in the present invention as the center discharge electrode, obviating the conventional rod-like center discharge electrode in the center bore of the insulator body. The center bore thus obtained by obviating the rod electrode is advantageous in permitting a larger space for receiving resistor material, sealing glass composition or the like than in the case where the rod electrode is used.

However, the resistor material has generally low thermal conductivity since it usually comprises glass and carbon, additionally incorporating semiconductive material and other inorganic substances. The sealing glass composition consisting of a mixture system of glass frit and metal powder cannot be free from deterioration in thermal conductivity mainly due to the presence of a glass phase.

Accordingly, the function of the controlling material would be diminished if a large proportion of the space which had been occupied by the rod electrode in the prior art would be occupied by those masses such as the resistor material and/or sealing glass composition sealed therein.

This embodiment accomplishes an improvement in this problem by filling the center bore space with the controlling material of the invention at least approximately up to a level of a stepped shoulder 37 on the insulator body which is the first one from the discharge end and is adapted to receive a metal shell to be mounted on the insulator body to form a spark plug assembly. The controlling material is filled in the center bore beginning from the bottom of its discharge end. In this construction, the heat of the spark plug discharge end can effectively be transferred (conducted) to the stepped shoulder portion 37 and further conducted to the metal shell 39 via a metal packing 38 abutting with the stepped shoulder portion 37. Thus the heat of the discharge end can with more ease be conducted and transferred in a direction toward the terminal rod 41, which eliminates the overheating of the spark plug discharge end at the peripheral region of the center discharge electrode 33 (i.e., enhances heat-resistant property) and improves the spark plug in its capability of eliminating or depressing the preignition.

The Seventh Embodiment

Based on the foregoing embodiments, the invention further provides a spark plug wherein the controlling material comprises a mixture powder of the metal powder and the refractory powder, the mixture powder including the higher amount of the metal powder provided with the higher conductivity, if a pertinent portion in the center bore is the nearer to the discharge end. This formulation permits higher conductivity for the discharge end.

The refractory powder in the controlling material by volume ratio amounts to approximately 10–40%; at the discharge end portion it amounts approximately 10–20% and at the terminal rod end portion approximately 20–40%. An exemplified composition comprises 80–90% by volume copper or copper alloy (mean particle size of 200–800 μm) and the balance of alumina (mean particle size of 100–500 μm) at a discharge end portion **34*a* as shown in FIG. 13, and 60–80% by volume copper or copper alloy (200–800 μm) and the balance of alumina (100–500 μm) at a terminal rod end portion 34*b***. The refractory powder as mentioned in the second embodiment is used also in this embodiment.

The controlling material for this embodiment further comprises 0–20% by volume of borosilicate glass powder as mentioned in the third embodiment. An exemplified composition in this embodiment comprises 60–90% copper, and the balance of alumina and/or silicon carbide together with 0–20% of the borosilicate glass powder, by volume percent respectively.

Figure 12:
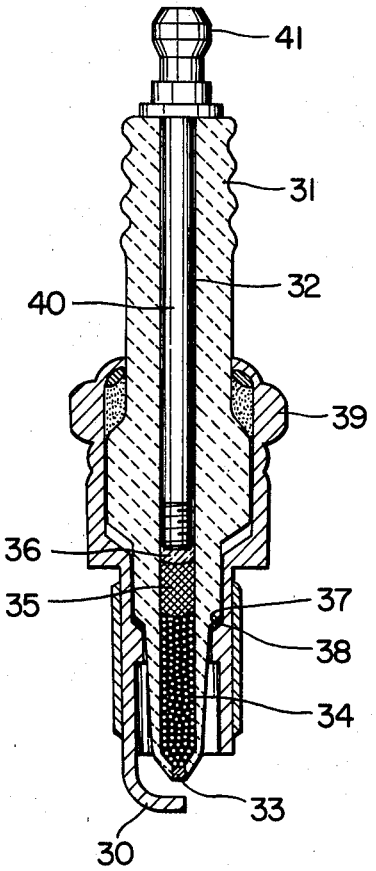
FIG. 12 shows a further embodiment of the spark plug assembly of the invention.
Figure 13:
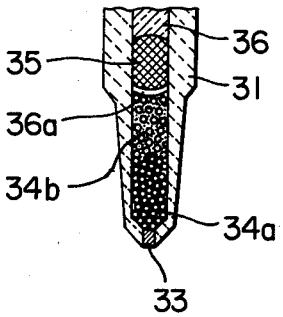
FIG. 13 shows still a further embodiment of a discharge end portion of the spark plug of the invention.

The present invention is further illustrated by a preferred combination with incorporation of a resistor material as shown in FIGS. 12 and 13.

In the center bore 32, the controlling material 34, resistor material 35 and a conductive sealing glass composition 36 are filled in order beginning from the discharge end, then a terminal rod 40 is inserted, and the structure finally is hot-pressed. The resistor material per se is a known one, which encompasses also the self-sealable resistor composition which is disclosed in U.S. Pat. No. 4,001,145–Sakai et al as a "glassy resistor composition". The disclosure of the above identified patent is hereby incorporated by reference into this specification.

A known conductive sealing glass composition may be applied in assemblying a spark plug assembly, e.g., one having a composition comprising 30–70% by weight of borosilicate glass and the balance of metallic powder of Cu, Ni, Fe, FeB, NiB or a mixture thereof. As the borosilicate glass composition, e.g., one having a composition of 15–45% $B_2O_3$, 40–70% $SiO_2$ and 3–10% $Al_2O_3$ by weight ratio, and other known borosilicate glasses may be used provided the softening temperature in approximately between 600°–900° C.

A preferred conductive sealing glass composition suitable for use in this invention is disclosed in U.S. patent application Ser. No. 185,419, filed Sept. 9, 1980, the disclosure of which has been published as Japanese Published Application No. 54-117839, laid open Sept. 12, 1979, which is assigned to the same assignee as the present invention, the disclosure of which is hereby incorporated in the specification of the present invention.

A conductive sealing glass composition **36*a* (FIG. 13) may also be applied between the resistor material 35 and the controlling material 34** as aforementioned, which application serves to seal the control material better.

According to this embodiment, the spark plug has a wide thermal range, providing a higher heat-resistance property, and is capable of self-cleaning and preventing preignition. The manufacturing process thereof is simple and contributes to lower cost.

The Eighth Embodiment

In the foregoing description, the controlling material and its suitable application in the spark plug are disclosed, whereas a preferred embodiment of the center discharge electrode which is suitable for employing in combination with the controlling material is disclosed hereinbelow.

In the eighth embodiment of the invention, a center bore 22 is formed with a sufficiently large diameter extending to the discharge end, in which center bore the controlling material 25 providing increasing conductance along with the increasing temperature is filled and sealed so that the center discharge end may be maintained at a desired temperature range (usually approximately 450°–900° C.) upon starting, during high speed running and under other various running conditions. In this formulation, the center discharge end temperature rapidly rises at low temperature, whereas if it reaches a higher prescribed temperature the heat is sufficiently transferred (conducted) or released from the discharge end exposed to a high temperature gas in the direction toward the terminal rod so that it is protected from overheating and preignition can be avoided. This controlling material with the above-mentioned temperature-dependency also contributes to eliminating wear of the center discharge electrode.

Figure 8:
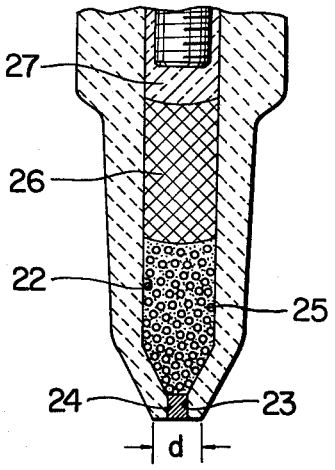
FIG. 8 shows an enlarged portion of FIG. 7.

The insulator body 21 is preferably tapered with an appropriate angle with its discharge end portion, the end portion thereof being provided with a ceramic center discharge electrode 24. The ceramic electrode 24 is prepared by charging the small center end bore 23 formed on a green insulator body with a ceramic electrode composition and simultaneously sintering resulting in an integral body. The ceramic electrode 24 may attain such configurations of the electrode 24 as shown in FIG. 8, which closes the center bore end in the same plane or thickness as the bottom end of the insulator or one shown as reference numeral 24*a* in FIG. 9, in which the end bore bore 23 is closed and thereafter retracts from the end, leaving a recess. Further modifications of the ceramic discharge electrode may be done without departing from the spirit of the present invention.

Figure 9:
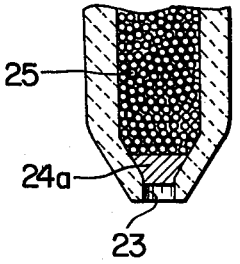
FIG. 9 shows another embodiment of the ceramic center discharge electrode of the invention.

The ceramic electrode 24*a* in FIG. 9 has the property of eliminating electrode wear through protecting the electrode from direct exposure to exploding gas due to the retracted electrode in the end bore 23 as well as self-cleaning the electrode periphery through discharging sparks sliding along the inner wall of the small center end bore 23. That is, deposited carbon on the inner wall of the end bore 23 can be burned out with arc heat.

The discharge end of the insulator body is preferably formed with a diameter d not exceeding 2 mm for better spark dischargeability.

Figure 10:
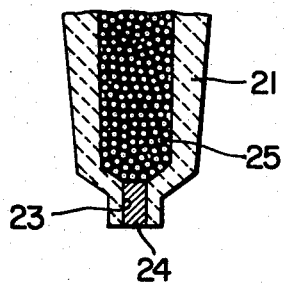
FIG. 10 shows a further embodiment of the discharge end portion of the invention.

A further embodiment as shown in FIG. 10 includes an insulator body 21 having a discharge end stepwisely formed with a small diameter (of not exceeding 2 mm) which includes a ceramic electrode 24 in the center end bore 23 simultaneously sintered with the insulator body 21.

The ceramic electrode material for this embodiment is a composition substantially consisting of a skeleton component consisting of oxide, carbide and/or nitride of titanium, and noble metal as an electric conductive component selected from the group consisting of Pt, Pd and alloys thereof with Au, Ag and/or Rh; which composition further optionally comprises alumina, chromium oxide, zirconia, silica and/or lanthania and/or metal selected from the group consisting of iron, nickel, chromium and alloys thereof. This composition is thoroughly mixed, finely dispersed and sintered. A preferred composition comprises 40–60% Pt, 20–30% Pd (this Pt and Pd forming a base), 10–30% of the skeleton component consisting of $TiO_2$, TiC and/or TiN, 0–3% Fe-Ni-Cr and 0–10% alumina, each by volume percent. This ceramic electrode is simultaneously sintered with the insulator body (usually around at 1600° C. in atmosphere) after the ceramic electrode material paste is filled in the discharge end bore 23 of a green insulator body. The paste is prepared by admixing an appropriate amount of organic binder with the ceramic electrode material, the organic binder being a known one such as varnish, glycerin or the like.

In the center bore 22, a controlling material 25, a resistor material 26 and a conductive sealing glass composition 27 are charged in order beginning from the discharge end, then the charged mass is hot-pressed. The resistor material may be a known one and also selfsealable resistor material (a preferred example being disclosed in U.S. Pat. No. 4,006,106 - Yoshida et al) may be used. A resistor material having a solid shape may be used, e.g., a coil type resistor which comprises electric resistor metal wire wound on a ferrite core.

A sealing glass composition as mentioned hereinbefore can be employed.

If desired, a conductive sealing glass composition may be applied in the center bore between the resistor material 26 and the controlling material, this incorporation of the sealing glass composition serves to better sealing for the resistor material and controlling material. The metal shell 29 and an outer electrode 20 can be selected from those as known per se.

This embodiment of the invention provides following specific effects and advantages:

(1) Improvement in the durability at high temperature and cost reduction due to the ceramic electrode being simultaneously sintered with the insulator body.

(2) Securing sufficient space in the center bore for receiving the controlling material, resistor material and conductive sealing glass composition, which space is made by eliminating the rod-like center electrode.

(3) Improved self-cleaning and long durability under high temperature due to the retracted structure of the ceramic electrode in the small end bore.

(4) Better ignitability due to the structure of the insulator body discharge end within a diameter of 2 mm.

(5) Better noise eliminating effect due to the ceramic on the discharge electrode having a low electric resistance value.

The Ninth Embodiment

Accordingly, the structure of the spark plug discharge end portion in the present invention obviates the conventional rod-like center electrode and consists in either the ceramic center electrode sintered at the insulator end or a tip-like metal center electrode thereat. The tip-like center electrode is such a small electrode piece that forms in the small end bore at its closed end in a desired shape (e.g., rivet-like form, T-like cross-section, or spherical). Descriptions of pending U.S. patent applications Ser. Nos. 185,955 and 185, 956, respectively entitled "Spark plug and manufacturing process thereof" and "Spark Plug with a sphere-like metal center electrode and manufacturing process thereof" both filed on Sept. 10, 1980 by the same applicant are hereby incorporated in the specification of the present invention.

The tip-like electrode is that of Ni; Ni-base alloy (Ni-Cr, Ni-Cr-Fe, Ni-Cr-Si, Ni-Si-Cr-Al); Au, Ag, Au-Ag alloy; alloy of Au, Ag or Au-Ag with Pd and/or Ni, Cr, Ni-Cr; Ag-Pt, Ag-Pd, or Ag-Ir alloy. Other known electrode metals may be used herein.

The tip-like center electrode can be prepared in the center small end bore of the insulator discharge end which has been prepared beforehand through fixing by inserting, pressing, melting (or fusing), hot-pressing, applying sealing glass composition or other known means. If desired, the sealing glass composition is applied in the center bore at its bottom end portion covering an inner end of the tip-like electrode.

Generally speaking, the controlling material which is charged in the center bore abutting the center discharge electrode must so tightly and with sufficient strength be sealed with its upper end portion that compressive force is exerted on the controlling material (metal powder) at high temperature. Subject to this requirement, a known resistor material or selfsealable resistor material may be incorporated if desired.

Accordingly, the present invention enables controlling the heat transfer (thermal conductivity) from the discharge end of the spark plug in the direction toward the terminal rod in accordance with the discharge end temperature, and provides a spark plug capable of high self-cleaning and preventing preignition, i.e., having a wide thermal range. In the present invention, the range to be controlled and the controlling characteristics may be adjusted as desired. Therefore, the conventional necessity for changing spark plugs corresponding to engine types, load conditions, seasons can be eliminated, and optimum conditions for ignition and explosion through the self-cleaning discharge end can be accomplished, providing great advantages in engine design, running and maintenance or inspection. Furthermore, the spark plug of the present invention permits simple processes of manufacture as well as low cost.

EXAMPLES

EXAMPLE 1

Figure 5:
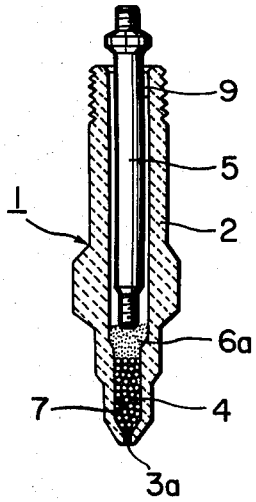
FIG. 5 shows a state at a stage before hot-pressing of the assembly of FIG. 1, however, with a different center discharge electrode.

A pressed green insulator body of high alumina content as shown in FIG. 5 provided with a small end bore 8 having a diameter of 1.0 mm and an axial length of 1.5 mm measured on a sintered and finished body was beforehand prepared. An electrode material paste comprising 100 parts by weight of a mixture powder consisting of 45% Pt, 25% Pd, 20% $TiO_2$ and 10% TiC (each by weight), and 1 part by weight of varnish admixed thereto was prepared and filled in the small end bore 8 then the insulator body and the center discharge electrode were simultaneously sintered at 1600° C. in the atmosphere resulting in an insulator body with a ceramic center discharge electrode 3*a* which is integrally sintered with the insulator body. The insulator body was glazed by a conventional manner resulting in a insulator body 2 having a center bore lower portion 7 for receiving the controlling material 4 with an inner diameter of 3.6 mm and a center bore upper portion 9 with an inner diameter of 4.7 mm for receiving a terminal rod.

A controlling material mixture comprising 75% by volume of spherical copper powder (200–800 μm) and the balance of alumina powder (100–500 μm) was beforehand prepared. 0.3 g of this mixture 4 was charged in the center bore lower portion 7, rammed and precompacted by applying an axial pressure of 5–10 kg/cm$^2$G, thereupon 0.1 g conductive sealing glass composition powder paste 6*a* (through 100 μm screen the powder comprising 50% by weight of borosilicate glass powder and the balance of ferro-boron alloy powder) was charged, rammed and precompacted by applying a pressure of 5–10 kg/cm$^2$G, the borosilicate glass consisting of 65% $SiO_2$, 30% $B_2O_3$ and 5% $Al_2O_3$ by weight ratio. Then a low carbon steel terminal rod 5 plated with nickel, having a rod portion diameter of 4.0 mm was inserted in the center bore 9 extending down onto the precompacted conductive sealing glass composition 6*a*. The resultant entire assembly was heated at a heating speed of 200° C./min up to 800°–1000° C., held at that temperature for 10 minutes, whereafter the assembly was hot-pressed applying an axial pressure of 16 kg/cm$^2$G upon a terminal rod head while the insulator body was secured counteractingly, resulting in an insulator assembly 1. The thermal conductivity of this insulator assembly was good, and a spark plug using this insulator assembly exhibited a heat value as defined by the SAE standard (SAE heat value indicative of average effective pressure), measured in a SC-17.6 engine, of 330 lbs/in$^2$.

EXAMPLE 2

Figure 6:
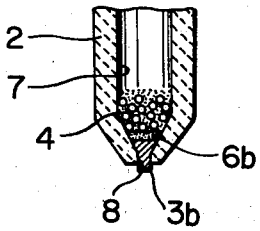
FIG. 6 shows an enlarged portional view of an embodiment with a tip-like center discharge electrode.
Figure 7:
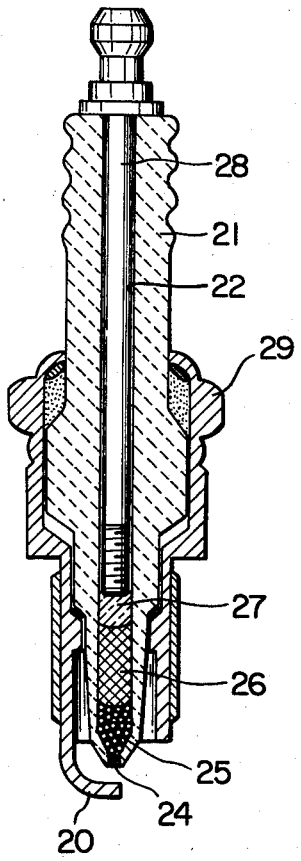
FIG. 7 shows a longitudinal cross-sectional view of an embodiment of the invention with a ceramic center discharge electrode.

An insulator body as shown in FIG. 5 for Example 1 without the ceramic discharge electrode 3*a* was obtained by sintering in the same way as in Example 1 except for not charging the electrode material as aforementioned in Example 1 in the small end bore 8. In the resultant small end bore 8, a rivet-like electrode tip as shown in FIG. 6 made of either a nickel alloy (each 1% by weight of Si, Cr and Al and the balance of Ni) or a Au-Pd alloy (50% by weight of Au, balance of Pd) was inserted, whereupon 0.1 g the same conductive sealing glass composition 6*b* as in Example 1 was charged and rammed in the center bore lower portion 7, further being filled 0.3 g of the same controlling material as in Example 1 on the resultant layer. An insulator assembly as partially shown in FIG. 6 was obtained. The thermal conductivity of this insulator assembly was as good as that of Example 1.

EXAMPLE 3

Various kinds of spherical metal powder, the same refractory powder as in Example 1 and the same conductive sealing glass composition as employed in the conductive sealing glass composition indicated in Example 1 were used for testing each effect. The insulator assemblies as shown in Example 1 were obtained in the same manner as in Example 1. All the resultant assemblies showed good thermal conductivity.

TABLE 1

| | spherical metal powder | | | refractory powder | | glass powder |
|---|---|---|---|---|---|---|
| Samples | metal powder | particle size μm | % by volume | particle size | % by volume | % by volume |
| 1 | Cu (>99.5%) | 800–1000 | 100 | — | 0 | 0 |
| 2 | " | 500 | 60 | 200–500 | 20 | 20 |
| 3 | " | 500 | 60 | " | 40 | 0 |
| 4 | " | 500 | 75 | 100–300 | 20 | 5 |
| 5 | " | 500 | 90 | " | 10 | 0 |

TABLE 1-continued

| Samples | spherical metal powder: metal powder | spherical metal powder: particle size μm | spherical metal powder: % by volume | refractory powder: particle size | refractory powder: % by volume | glass powder: % by volume |
|---|---|---|---|---|---|---|
| 6 | " | 200 | 75 | " | 25 | 0 |
| 7 | Cu powder<br>Ni powder | 500–800<br>400–600 | 50<br>25 | " | 25 | 0 |
| 8 | Fe—Ni—Cr alloy* | 500 | 75 | " | 25 | 0 |
| 9 | Cu—Ni alloy (10% Ni) | 500 | 75 | " | 25 | 0 |
| 10 | Cu—Cr alloy (1% Cr) | 500 | 75 | " | 25 | 0 |
| 11 | Cu—Zn alloy (10% Zn) | 500 | 75 | " | 25 | 0 |
| 12 | Cu—Sn—P alloy (8% Sn, 0.03% p) | 500 | 75 | " | 25 | 0 |
| 13 | Cu—Al alloy (5% Al) | 500 | 75 | " | 25 | 0 |

*Note: 8% Ni, 18% Cr, balance Fe; austenitic stainless steel percent of metal component is expressed by weight ratio.

EXAMPLE 4

Spherical metal powders coated with an oxidized layer of approximately 5–10 μm thickness were obtained by heat-treating 100 g each spherical metal powders of copper, iron (low carbon mild steel 0.1% C), nickel, chromium, each of commercial standard and having a particle size of 200–800 μm in the atmosphere for one hour. Those oxidized spherical metal powders were used as the controlling material for manufacturing the insulator assembly as shown in Example 1. The resultant assemblies exhibited also good conductivity.

EXAMPLE 5

100 g spherical copper powder (200–800 μm ) was dipped in a silicon carbide (through 50 μm screen) aqueous slurry comprising 20% weight of silicon carbide, then the powder was allowed to dry at 500° C. for one hour resulting in SiC-coated copper powder (ceramic coated powder).

EXAMPLE 6

Spherical copper powder (200–800 μm) was employed in Example 5 and the balance of ceramic-coated spherical copper powder as obtained in Example 5 were admixed in stepwise volumetric ratios from 10:90 to 90:10 in five steps with a constant interval resulting in a series of controlling materials. These controlling materials were used for preparing the assembly as shown in Example 1 in the same manner as Example 1 except for the employment of these controlling materials. The resultant assembly exhibited good properties.

EXAMPLE 7

Insulator bodies having ceramic discharge electrode as shown in FIG. 12 by employing ceramic electrode material compositions listed in Table 2 were prepared in other points in the same manner as in Example 1.

Then a mixture powder comprising 80–90% by volume of the same spherical copper powder as used in Example 1 and the balance of alumina (100–500 μm) was charged in the center bore 32 from the discharge end bottom thereof up to a level of ½ heith of that from the bottom up to a stepped shoulder 37 on the insulator body which is a first one from the discharge end, whereupon another mixture powder comprising 60–80% by volume the same copper powder and the balance of alumina was charged up to the stepped shoulder 37.

Then a resistor material 35 as disclosed in U.S. Pat. No. 4,173,731 (the description concerning this resistor material in the above U.S. patent application is hereby incorporated herein), 40 weight parts borosilicate glass, 30 weight parts zirconia powder, 30 weight parts $Si_3N_4$ powder, 2 weight parts carbonaceous material [methylcellulose] was filled, whereupon 0.1 g the conductive sealing glass composition as in Example 1 was charged by hot-pressing in the same manner as in Example 1. A shell metal 39 with a ground electrode was mounted on this insulator assembly resulting in a spark plug. This spark plug exhibited good properties, particularly good self-cleaning and no troubles on preignition or the like were observed during a durability test wherein the spark plug was tested mounted on a 4 cycle gasoline engine with 1800 ml displacement in a test operation of 4/4 load×5000 rpm×100 hours. The discharge end of the spark plug was clean after this testing.

The SAE heat values were measured by using SC-17.6 engine resulting in values of 340–350 lbs/in$^2$.

TABLE 2

| ingredients | scope (% by weight) | Sample No. 1 | 2 | 3 | 4 (% by weight) |
|---|---|---|---|---|---|
| Pt | (40–60) | 40 | 50 | 60 | 45 |
| Pd | (20–30) | 30 | 25 | 20 | 25 |
| $TiO_2$, TiC, TiN | (10–30) | TiC 30 | $TiO_2$ 20 | TiN 20 | $TiO_2$ 10<br>TiC 10 |
| Fe—Ni—Cr* | (0–3) | — | 3 | — | — |
| $Al_2O_3$ | (0–10) | — | 2 | — | 10 |

*Note: stainless steel (8% Ni, 18% Cr, balance Fe)

REFERENCE TEST

Figure 11:
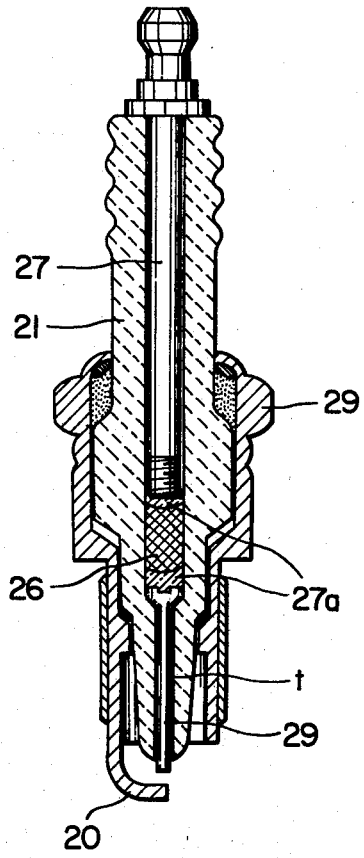
FIG. 11 shows a typical conventional spark plug with a rod-like center discharge electrode.

The SAE heat value was measured at a spark plug of a conventional type as shown in FIG. 11, which value amounted to about 290 lbs/in$^2$.

We claim:

1. A spark plug comprising an insulator body having a center bore therethrough, a bottom end defining a discharge end of the insulator body and a discharge center electrode formed in the discharge end, wherein a thermal conductivity-controlling material comprising a spherical metal powder as an essential element thereof is charged into the center bore at the discharge end thereof, said material being adapted to control the thermal conductivity of the spark plug over a wide temperature range.

2. A spark plug defined in claim 1 wherein the spherical metal powder is that of metal, an alloy or a mixture selected from the group consisting of:

a. copper, iron, nickel and chromium;
b. ferro-alloy or nickel alloy of Fe-Ni, Fe-Cr, Fe-Ni-Cr and Ni-Cr;
c. copper alloy of Cu-Ni and Cu-Cr; and
d. copper alloy of Cu-Zn, Cu-Zn-Pb, Cu-Sn-P, Cu-Sn-Zn, Cu-Al, Cu-Al-Ni-Fe and Cu-Zn-Al.

3. A spark plug defined in claim 1 wherein the spherical metal powder has an approximate mean particle size of from 100 to 1000 μm.

4. A spark plug defined in claim 1 wherein the thermal conductivity-controlling material comprises a major part of said spherical metal powder and from 10 to 40 percent by volume of refractory powder having an approximate mean particle size of from 10 to 500 μm essentially consisting of oxide, nitride, carbide, or silicide of metal or mixture thereof.

5. A spark plug defined in claim 4, wherein the refractory powder is alumina, nitride of aluminium or titanium, carbide of silicon, titanium, zirconium or boron, silicide of molybdenum or titanium or a mixture thereof.

6. A spark plug defined in claim 1 wherein the thermal conductivity-controlling material comprises not less than 60 percent by volume of the spherical metal powder.

7. A spark plug defined in claim 4 wherein the thermal conductivity-controlling material comprises from 60 to 90 percent by volume of the spherical metal powder.

8. A spark plug defined in claim 4 wherein the thermal conductivity-controlling material comprises not exceeding 20 percent by volume of glass powder together with the refractory powder.

9. A spark plug defined in claim 8 wherein the glass powder is boro-silicate glass powder which has a softening point of approximately from 600° to 900° C.

10. A spark plug defined in any of claims 1–3 or 5–9 wherein the spherical metal powder is coated with a ceramic coating layer.

11. A spark plug defined in claim 10 wherein the ceramic coating layer is an oxidized coating layer formed through heat treatment of the spherical metal powder or a layer substantially consisting of oxide of alminium, titan, zirconium or silicon, nitride of alminium, boron, titanium or zirconium, carbide of titanium, silicon, molybdenum or boron, silicide of molybdenum or titanium, or a complex layer thereof.

12. A spark plug comprising an insulator body having a center bore therethrough, a bottom end defining a discharge end of the insulator body and a discharge center electrode formed in the discharge end, wherein a thermal conductivity controlling material comprising a spherical metal powder and a spherical metal powder coated with a ceramic coating layer as an essential element thereof is charged into the center bore at the discharge end thereof to provide control of the thermal conductivity of the spark plug over a wide temperature range, which controlling material contains from 10 to 90 percent by volume of the spherical metal powder coated with the ceramic coating layer, the balance being the spherical metal powder.

13. A spark plug defined in claim 12 wherein the spherical metal powder and the ceramic-coated spherical metal powder are that of metal, and alloy or a mixture selected from the group consisting of:

a. copper, iron, nickel and chromium;
b. ferro-alloy or nickel alloy of Fe-Ni, Fe-Cr, Fe-Ni-Cr and Ni-Cr;
c. copper alloy of Cu-Ni and Cu-Cr; and
d. copper alloy of Cu-Zn, Cu-Zn-Pb, Cu-Sn-P, Cu-Sn-Zn, Cu-Al, Cu-Al-Ni-Fe and Cu-Zn-Al which alloy comprises Sn, Zn, Al and/or Pb having a substantially lower melting point than copper and the base copper alloy c.

14. A spark plug defined in claim 12 or 13 wherein the ceramic coating layer is an oxidized coating layer formed through heat treatment of the spherical metal powder or a layer substantially consisting of oxide of alminium, boron, titanium or zirconium, carbide of titanium, silicon, molybdenum or boron, silicide of molybdenum or titanium, or a complex layer thereof.

15. A spark plug defined in claim 1, 4, 8 or 12 wherein the thermal conductivity-controlling material is charged in the center bore from its discharge end bottom approximately up to a level of a stepped shoulder on the insulator body which is a first one from the discharge end and adapted to receive a metal shell to be mounted on the insulator body.

16. A spark plug defined in claim 10 wherein the thermal conductivity-controlling material is charged into the center bore from its discharge end bottom approximately up to a level of a stepped shoulder on the insulator body which is a first one from the discharge end and adapted to receive a metal shell to be mounted on the insulator body.

17. A spark plug defined in claim 4, 8 or 12, wherein the thermal conductivity-controlling material comprises a mixture of the spherical metal powder and the refractory powder varying in composition through the center bore, the portion of mixture including the higher amount of the spherical powder and having the higher thermal conductivity being disposed nearer to the center discharge electrode end of the plug.

18. A spark plug defined in claim 15, wherein the thermal conductivity-controlling material comprises a mixture of the spherical metal powder and the refractory powder varying in composition through the center bore, the portion of mixture including the higher amount of the spherical powder and having the higher thermal conductivity being disposed nearer to the center discharge electrode end of the plug.

19. A spark plug defined in claim 4, 8 or 12 wherein the center discharge electrode is a ceramic electrode which is simultaneously sintered with the insulator body formed at the center discharge electrode end portion of the center bore and composed of a complex electrode material having a composition of platinum group metal and ceramic material.

20. A spark plug defined in claim 10 wherein the center discharge electrode is a ceramic electrode which is simultaneously sintered with the insulator body formed at the center discharge electrode end portion of the center bore and composed of a complex electrode material having a composition of platinum group metal and ceramic material.

21. A spark plug defined in claim 15 wherein the center discharge electrode is a ceramic electrode which is simultaneously sintered with the insulator body formed at the center discharge electrode end portion of the center bore and composed of a complex electrode material having a composition of platinum group metal and ceramic material.

22. A spark plug defined in claim 19 wherein electrical resistor material for noise elimination is filled and sealed in the center bore in order of the thermal conductivity-controlling material and the resistor material beginning from the discharge end.

23. A spark plug defined in claim 10 wherein an electrical resistor material for noise elimination is filled and sealed in the center bore in order of the thermal conductivity-controlling material and the resistor material beginning from the discharge end.

24. A spark plug defined in claim 15 wherein an electrical resistor material for noise elimination is filled and sealed in the center bore in order of the thermal conductivity-controlling material and the resistor material beginning from the discharge end.

25. A spark plug defined in claim 19 wherein the ceramic center discharge electrode has a composition substantially consisting of a skeleton component consisting of oxide, carbide and/or nitride of titanium, and noble metal selected from the group consisting of Pt, Pd and alloys thereof with Au, Ag and/or Rh; said composition further optionally comprising alumina, chromium oxide, zirconia, silica and/or lantania, and/or metal selected from the group consisting of iron, nickel, chromium and alloys thereof; and said composition being finely dispersed and sintered.

26. A spark plug defined in claim 10 wherein the ceramic center discharge electrode has a composition substantially consisting of a skeleton component consisting of oxide, carbide and/or nitride of titanium, and noble metal selected from the group consisting of Pt, Pd and alloys thereof with Au, Ag and/or Rh; said composition further optionally comprising alumina, chromium oxide, zirconia, silica and/or lantania, and/or metal selected from the group consisting of iron, nickel, chromium and alloys thereof; and said composition being finely dispersed and sintered.

27. A spark plug defined in claim 15 wherein the ceramic center discharge electrode has a composition substantially consisting of a skeleton component consisting of oxide. carbide and/or nitride of titanium, and noble metal selected from the group consisting of Pt, Pd and alloys thereof with Au, Ag and/or Rh; said composition further optionally comprising alumina, chromium oxide, zirconia, silica and/or lantania, and/or metal selected from the group consisting of iron, nickel, chromium and alloys thereof; and said composition being finely dispersed and sintered.

28. A spark plug defined in claim 19 wherein the ceramic center discharge electrode has a composition essentially consisting of, each by weight percent, 40–60% platinum, 20–30% paradium, 10–30% the skeleton component consisting of oxide, carbide and/or nitride of titanium, 0–3% Fe-Ni-Cr alloy and 0–10% alumina.

29. A spark plug defined in claim 10 wherein the ceramic center discharge electrode has a composition essentially consisting of, each by weight percent, 40–60% platinum, 20–30% paradium, 10–30% the skeleton component consisting of oxide, carbide and/or nitride of titanium, 0–3% Fe-Ni-Cr alloy and 0–10% alumina.

30. A spark plug defined in claim 15 wherein the ceramic center discharge electrode has a composition essentially consisting of, each by weight percent, 40–60% platinum, 20–30% paradium, 10–30% the skeleton component consisting of oxide, carbide and/or nitride of titanium, 0–3% Fe-Ni-Cr alloy and 0–10% alumina.

31. A spark plug defined in claim 2 or 13 wherein said copper alloy comprising Zn includes not exceeding 40 percent by weight of Zn.

* * * * *